US012404573B2

(12) United States Patent
Kasai et al.

(10) Patent No.: US 12,404,573 B2
(45) Date of Patent: Sep. 2, 2025

(54) FREE-CUTTING STEEL AND MANUFACTURING METHOD THEREOF

(71) Applicant: JFE STEEL CORPORATION, Tokyo (JP)

(72) Inventors: Masayuki Kasai, Tokyo (JP); Kazuaki Fukuoka, Tokyo (JP); Kimihiro Nishimura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 572 days.

(21) Appl. No.: 17/757,601

(22) PCT Filed: Dec. 23, 2020

(86) PCT No.: PCT/JP2020/048236

§ 371 (c)(1),
(2) Date: Jun. 17, 2022

(87) PCT Pub. No.: WO2021/132371

PCT Pub. Date: Jul. 1, 2021

(65) Prior Publication Data

US 2023/0029298 A1 Jan. 26, 2023

(30) Foreign Application Priority Data

Dec. 23, 2019 (JP) ..... 2019-231913
Feb. 4, 2020 (WO) ..... PCT/JP2020/004002

(51) Int. Cl.

| | |
|---|---|
| ***C22C 38/60*** | (2006.01) |
| ***B21B 1/02*** | (2006.01) |
| ***B21B 1/08*** | (2006.01) |
| ***C21D 8/02*** | (2006.01) |
| ***C22C 38/00*** | (2006.01) |
| ***C22C 38/38*** | (2006.01) |

(52) U.S. Cl.

CPC ..... *C22C 38/60* (2013.01); *B21B 1/02* (2013.01); *B21B 1/0805* (2013.01); *C21D 8/0226* (2013.01); *C22C 38/001* (2013.01); *C22C 38/002* (2013.01); *C22C 38/38* (2013.01); *B21B 2001/022* (2013.01)

(58) Field of Classification Search

None

See application file for complete search history.

(56) References Cited

U.S. PATENT DOCUMENTS

| | | | |
|---|---|---|---|
| 8,124,008 | B2 | 2/2012 | Murakami et al. |
| 2003/0152476 | A1 | 8/2003 | Matsui et al. |
| 2009/0050241 | A1 | 2/2009 | Hashimura et al. |
| 2023/0029298 | A1 | 1/2023 | Kasai et al. |
| 2023/0108640 | A1 | 4/2023 | Kasai et al. |
| 2025/0230530 | A1 | 7/2025 | Tada et al. |

FOREIGN PATENT DOCUMENTS

| | | | | |
|---|---|---|---|---|
| JP | H026824 | B2 | 2/1990 | |
| JP | H10925539 | A | 1/1997 | |
| JP | 2000160284 | A | 6/2000 | |
| JP | 2005232508 | A | 9/2005 | |
| JP | 2005307243 | A | 11/2005 | |
| WO | WO-03046240 | A1 * | 6/2003 | ..... C22C 38/002 |
| WO | 2014125770 | A1 | 8/2014 | |
| WO | 2014125779 | A1 | 8/2014 | |

OTHER PUBLICATIONS

Mar. 23, 2021, International Search Report issued in the International Patent Application No. PCT/JP2020/048236.

* cited by examiner

*Primary Examiner* — Anthony M Liang
(74) *Attorney, Agent, or Firm* — KENJA IP LAW PC

(57) ABSTRACT

Free-cutting steel includes a specific composition, with an A value defined by a following formula (1) satisfying 4.0 or more and 20.0 or less, and remainder having Fe and an unavoidable impurity; and texture with 1000 or more sulfide particles with an equivalent circle diameter of less than 1 μm per $mm^2$, 500 or more sulfide particles with an equivalent circle diameter of 1 μm or more and 5 μm or less per $mm^2$, and 1000 or more Pb particles with an equivalent circle diameter of 1 μm or less per $mm^2$, wherein $$A\ value=(Mn+5Cr)/S \quad (1)$$

here, symbols of elements in the formula indicate contents (% by mass) of the elements.

4 Claims, No Drawings

FREE-CUTTING STEEL AND MANUFACTURING METHOD THEREOF

TECHNICAL FIELD

This disclosure relates to free-cutting steel, in particular, free-cutting steel containing sulfur and a small amount of lead, which are machinability improving elements, as a substitute for conventional free-cutting steel, and a manufacturing method thereof.

BACKGROUND

Sulfur-lead composite free-cutting steel containing low-carbon sulfur and lead, as typified by JIS4804 SUM24L, ensures excellent machinability by adding large amounts of lead (Pb) and sulfur (S) as machinability improving elements. Among these, lead is an extremely important and useful element for industrial products. In other words, lead is heavily used as an element that greatly improves the machinability of steel materials, that is, reduction in tool wear, improvement in chip handling, and the like in cutting work of the steel materials.

However, with growing awareness of environmental conservation in recent years, there has been a worldwide movement to abolish or restrict the use of environmentally hazardous substances. Lead (Pb) is one of such substances whose use is required to be restricted.

For example, Patent Literature (PTL) 1 discloses Pb-free free-cutting non-tempered steel. Similarly, PTL 2 also discloses Pb-free free-cutting steel. Furthermore, PTL 3 discloses free-cutting steel in which Cr, which is easier to make compounds with S than Mn, is added to be changed into Mn—Cr—S inclusions, in order to contribute to improvement in machinability.

CITATION LIST

Patent Literature

PTL 1: JPH09-25539A
PTL 2: JP2000-160284A
PTL 3: JPH02-6824B

SUMMARY

Technical Problem

The technology described in PTL 1 has problems of hardness because a target steel grade is non-tempered steel containing 0.2% or more of C, and high manufacturing cost because of the use of Nd being a special element. The technology described in PTL 2 has low hot ductility due to addition of a large amount of S, and is prone to cracking during continuous casting and hot-rolling, which is problematic from the viewpoint of surface properties. On the other hand, in the technology described in PTL 3, Cr and S are added as components, while the additive amount of Mn is reduced, but the additive amount of Cr is as high as 3.5% or more, which makes it difficult to lower cost, and a large amount of CrS is generated, which causes a manufacturing problem of difficulty in melting a material in a steel manufacture process. In addition, none of the literatures describe sulfur-lead composite free-cutting steel for heavy cutting (requiring considerable cutting work), as typified by JIS SUM24L, as a comparative example in an example. The literatures describe only steel with relatively little need for machinability, and it is apparent that the machinability is not sufficient in any of the steel.

It would be helpful to provide free-cutting steel whose machinability is equal to or better than that of low-carbon sulfur-lead composite free-cutting steel, by adding a significantly reduced amount of Pb compared to a conventional additive amount.

Solution to Problem

As a result of diligent research to solve the above problems, the inventors have arrived at the following findings.

(1) It is found out that by adding appropriate amounts of Cr, Mn, and S and optimizing the ratio of (Mn+5Cr)/S, the composition of an appropriate amount of sulfide is in a composite system of Mn—Cr—S, and that the sulfide with the composition in the composite system is refined during hot-working. This fine composite sulfide enables free-cutting steel to have excellent lubricity during cutting work.

(2) The finer the above-described sulfide, the greater the lubricating action, which significantly improves tool life and surface properties after cutting.

(3) On the other hand, the use of the fine sulfide alone causes continuous chips during cutting, which deteriorates processability. However, by dispersing the fine sulfide and, at the same time, allowing a certain range of relatively large sulfide to exist, chip handling during cutting can be significantly improved.

(4) When a certain amount of Pb is added at the same time, the Pb can be finely dispersed as well as the sulfide, and therefore machinability can be improved over conventional materials with the smaller amount of Pb than before.

This disclosure is based on the above findings, and we provide:

1. Free-cutting steel including:
a composition of, in % by mass,
0.15% or less of C,
0.5% or more and 2.0% or less of Mn,
0.200% or more and 0.650% or less of S,
more than 0.01% and 0.05% or less of O,
0.05% or more and 2.00% or less of Cr,
0.02% or more and less than 0.10% of Pb,
0.005% or more and 0.015% or less of N,
with an A value defined by a following formula (1) satisfying 4.0 or more and 20.0 or less, and
remainder having Fe and an unavoidable impurity; and
texture with 1000 or more sulfide particles with an equivalent circle diameter of less than 1 μm per $mm^2$, 500 or more sulfide particles with an equivalent circle diameter of 1 μm or more and 5 μm or less per $mm^2$, and 1000 or more Pb particles with an equivalent circle diameter of 1 μm or less per $mm^2$,
wherein $$\text{A value}=(Mn+5Cr)/S \quad (1)$$

here, symbols of elements in the formula indicate contents (% by mass) of the elements.

2. The free-cutting steel according to the above 1, wherein the composition further contains, in % by mass, any one or more of:
0.10% or less of Si;
0.01% or more and 0.15% or less of P; and
0.010% or less of Al.

3. The free-cutting steel according to the above 1 or 2, wherein the composition further contains, in % by mass, any one or more of:

0.0010% or less of Ca;
0.30% or less of Se;
0.15% or less of Te;
0.20% or less of Bi;
0.020% or less of Sn;
0.025% or less of Sb;
0.010% or less of B;
0.50% or less of Cu;
0.50% or less of Ni;
0.100% or less of Ti;
0.20% or less of V;
0.050% or less of Zr; and
0.0050% or less of Mg.

4. A manufacturing method of free-cutting steel, including:

forming a rectangular cast steel whose cross section perpendicular to a longitudinal direction has a side length of 200 mm or more, the cast steel having a composition of, in % by mass,
0.15% or less of C,
0.5% or more and 2.0% or less of Mn,
0.200% or more and 0.650% or less of S,
more than 0.0100% and 0.0500% or less of O,
0.05% or more and 2.00% or less of Cr,
0.02% or more and less than 0.10% of Pb,
0.005% or more and 0.015% or less of N,
with an A value defined by a following formula (1) satisfying 4.0 or more and 20.0 or less, and
remainder having Fe and an unavoidable impurity;
hot-rolling the cast steel into a billet at a surface reduction rate of 60% or more; and
hot-working the billet into a steel bar at a heating temperature of 1050° C. or more and a surface reduction rate of 65% or more.

5. The manufacturing method of free-cutting steel according to the above 4, wherein the composition further contains, in % by mass, any one or more of:
0.10% or less of Si;
0.01% or more and 0.15% or less of P; and
0.010% or less of Al.

6. The manufacturing method of free-cutting steel according to the above 4 or 5, wherein the composition further contains, in % by mass, any one or more of:
0.0010% or less of Ca;
0.30% or less of Se;
0.15% or less of Te;
0.20% or less of Bi;
0.020% or less of Sn;
0.025% or less of Sb;
0.010% or less of B;
0.50% or less of Cu;
0.50% or less of Ni;
0.100% or less of Ti;
0.20% or less of V;
0.050% or less of Zr; and
0.0050% or less of Mg.

Advantageous Effect

It is possible to obtain low-carbon free-cutting steel with excellent machinability, even with a low lead content.

DETAILED DESCRIPTION

Next, our free-cutting steel will be described in detail. First, reasons for limiting the content of each component in the composition of the free-cutting steel will be described in sequence. Note that, the expression of % for the components means % by mass unless otherwise specified.

C: 0.15% or less

C is an important element that has a significant effect on the strength and machinability of steel. However, when a content exceeds 0.15%, the steel becomes too hard and strong, and the machinability deteriorates. Therefore, the C content should be within a range of 0.15% or less, and preferably 0.10% or less. From the viewpoint of ensuring the strength, the C content should be 0.02% or more, and preferably 0.04% or more.

Mn: 0.5% or more and 2.0% or less

Mn is a sulfide-forming element important for machinability. However, when a content is less than 0.5%, the amount of sulfide is small and sufficient machinability cannot be obtained, so a lower limit should be 0.5%. On the other hand, when the content exceeds 2.0%, the sulfide coarsens and elongates, thus resulting in reduction in the machinability. In addition, mechanical properties are reduced, so an upper limit of the Mn content should be 2.0%. The Mn content is preferably 0.6% or more and less than 1.8%.

S: 0.200% or more and 0.650% or less

S is an element that contributes to formation of sulfide, which is effective for machinability. When an S content is less than 0.200%, the amount of the sulfide is small, thus resulting in small effect of improving the machinability. On the other hand, when the S content exceeds 0.650%, the sulfide become too coarse and its number is reduced, thus resulting in reduction in the machinability. In addition, hot workability and ductility, which is one of important mechanical properties, are reduced. Therefore, the S content should be within a range of 0.200% or more and 0.650% or less. The S content is preferably 0.250% or more. The S content is also preferably 0.500% or less.

O: more than 0.01% and 0.05% or less

In addition to forming oxide and serving as nuclei for sulfide precipitation, O is an effective element for restraining elongation of sulfide during hot-working such as rolling, and machinability can be improved by this action. However, when a content is 0.01% or less, the effect of restraining the elongation of the sulfide is not sufficient, and elongated sulfide remains and the original effect cannot be expected. On the other hand, when more than 0.05% of O is added, the effect of restraining the elongation of the sulfide is saturated and the amount of hard oxide inclusions increases, and furthermore, addition of an excessive amount of O has economically disadvantage. Therefore, the O content should be more than 0.01% and 0.05% or less. The 0 content is preferably 0.012% or more. The O content is also preferably 0.030% or less.

Cr: 0.05% or more and 2.00% or less

Cr forms sulfide, and acts to improve machinability by lubricating action during cutting. Also, Cr restrains elongation of the sulfide during hot-working such as rolling, so the machinability can be improved. When a Cr content is less than 0.05%, generation of the sulfide is not sufficient and elongated sulfide tends to remain, so that the original sufficient effect cannot be expected. On the other hand, when more than 2.00% of Cr is added, in addition to hardening, the sulfide becomes coarse and the effect of restraining the elongation of the sulfide is saturated, which even results in reduction in the machinability. Furthermore, addition of an excessive amount of the alloying element is economically disadvantageous. Therefore, the Cr content should be 0.05% or more and 2.00% or less. The Cr content is preferably 0.06% or more. The Cr content is also preferably 1.80% or less.

Pb: 0.02% or more and less than 0.10%

When Pb is finely dispersed, Pb contributes to increase a lubricating effect during cutting, and has a significant effect on improvement in machinability. However, when 0.10% or more of Pb is added, Pb becomes agglomerated and coarse, and the effect is lost. When less than 0.02% of Pb is finely dispersed, the amount of dispersion is too small to be effective.

N: 0.005% or more and 0.015% or less

N forms nitrides with Cr and the like, and decomposition of the nitrides, due to increase in temperature during cutting work, forms an oxide film called Belag on a tool surface. Since the Belag acts to protect the tool surface and increases tool life, N should be contained by 0.005% or more. On the other hand, when more than 0.015% of N is added, the effect of the Belag is saturated and a material becomes harder, thus resulting in shortening the tool life. Therefore, an N content should be 0.005% or more and 0.015% or less. The N content is preferably 0.006% or more. The N content is also preferably 0.012% or less.

As well as the above components, the remainder contains Fe and unavoidable impurities. Alternatively, optional components as described below are further contained. Here, as well as the above components, the optional components to be described later, and the remainder of Fe and the unavoidable impurities are preferably contained.

In the above composition, it is essential that an A value defined by the following formula (1) should satisfy 4.0 or more and 20.0 or less.

$$\text{A value}=(\text{Mn}+5\text{Cr})/\text{S} \quad (1)$$

Here, the symbols of elements in the formula indicate the contents (mass %) of the elements.

Namely, the A value is an important index that determines refinement of sulfide during hot-working such as rolling and refinement of sulfide and Pb, and limiting this ratio enables to improve machinability. When the A value is less than 4.0, sulfide of Mn—S alone is generated and coarse sulfide becomes abundant, thus resulting in deterioration in the machinability. Since the sulfide also serves as precipitation nuclei for Pb, the coarse sulfide makes it difficult for Pb to be finely dispersed. On the other hand, when the A value exceeds 20.0, the effect of finely dispersing the sulfide and Pb becomes saturated. In addition, the sulfide-forming elements become too much in relation to sulfur, and the sulfide becomes coarse. Therefore, the A value should be in a range of 4.0 or more and 20.0 or less. The A value is preferably 4.5 or more. The A value is also preferably 18.0 or less.

Next, the optional components will be described. In addition to the above fundamental components, the following components can be contained as needed:

any one or more of:

0.10% or less of Si;

0.01% or more and 0.15% or less of P; and 0.010% or less of Al.

Si: 0.10% or less

Si is an element used for deoxidation before refining. However, Si is added too much, a lot of hard oxides are present after the deoxidation, which causes deterioration in tool life due to abrasive wear. Therefore, an Si content should be 0.10% or less. The Si content is preferably 0.03% or less P: 0.01% or more and 0.15% or less P is an element effective at reducing finished surface roughness by restraining generation of built-up edges during cutting work. For this reason, it is preferable that P should be contained by 0.01% or more. On the other hand, when a P content exceeds 0.10%, the steel becomes harder and its hot workability and ductility decrease significantly. Therefore, the P content is within a range of 0.15% or less, preferably 0.10% or less.

Al: 0.010% or less

As well as Si, Al is a deoxidizing element and generates $Al_2O_3$. Since this oxide is hard and decreases cutting tool life due to so-called abrasive wear, its additive amount should be reduced to 0.010% or less, preferably to 0.005% or less.

In addition, the following components may be contained as needed:

any one or more of:

0.0010% or less of Ca;

0.30% or less of Se;

0.15% or less of Te;

0.20% or less of Bi;

0.020% or less of Sn;

0.025% or less of Sb;

0.010% or less of B;

0.50% or less of Cu;

0.50% or less of Ni;

0.100% or less of Ti;

0.20% or less of V;

0.050% or less of Zr; and 0.0050% or less of Mg.

Namely, Ca, Se, Te, Bi, Sn, Sb, B, Cu, Ni, Ti, V, Zr, and Mg are all preferably contained when importance is placed on machinability. When any element selected from these elements is contained, respective contents are preferably as follows, from the viewpoint of expressing action of improving the machinability: Ca: 0.0001% or more; Se: 0.02% or more; Te: 0.10% or more; Bi: 0.02% or more; Sn: 0.003% or more; Sb: 0.003% or more; B: 0.004% or more; Cu: 0.05% or more; Ni: 0.05% or more; Ti: 0.003% or more; V: 0.005% or more; Zr: 0.005% or more; and Mg: 0.0005% or more.

On the other hand, more than 0.0010% of Ca, more than 0.30% of Se, more than 0.15% of Te, more than 0.20% of Bi, more than 0.020% of Sn, more than 0.025% of Sb, more than 0.010% of B, more than 0.50% of Cu, more than 0.50% of Ni, more than 0.100% of Ti, more than 0.20% of V, more than 0.050% of Zr, or more than 0.0050% of Mg causes saturation of this effect and economical disadvantage.

Therefore, the content range of each element is as follows: Ca: 0.0010% or less; Se: 0.30% or less; Te: 0.15% or less; Bi: 0.20% or less; Sn: 0.020% or less; Sb: 0.025% or less; B: 0.010% or less; Cu: 0.50% or less; Ni: 0.50% or less; Ti: 0.100% or less; V: 0.20% or less; Zr: 0.050% or less; and Mg: 0.0050% or less.

(Texture)

Texture with 1000 or more sulfide particles with an equivalent circle diameter of less than 1 μm per $mm^2$, 500 or more sulfide particles with an equivalent circle diameter of 1 μm or more and 5 μm or less per $mm^2$, and 1000 or more Pb particles with an equivalent circle diameter of 1 μm or less per $mm^2$ With respect to the texture of the free-cutting steel, fine dispersion of sulfide particles and Pb particles is advantageous in promoting lubricating action between a tool and a work material during cutting work. The more the finely dispersed sulfide particles, the greater the lubricating action, and the better the tool life and surface properties after cutting. In steel containing Pb in the above range, when a large number of fine sulfide particles are dispersed, Pb particles are dispersed finely as well as the sulfide particles. When the Pb particles are dispersed finely, the effect of improving the machinability per Pb content in the steel increases. To achieve this, a certain amount or more of sulfide particles with an equivalent circle diameter of less than 1 μm and a certain amount or more of Pb particles with an equivalent circle diameter of 1 μm or less are required to be dispersed. Specifically, 1000 or more sulfide particles with an equivalent circle diameter of less than 1 μm per $mm^2$ and 1000 or more Pb particles with an equivalent circle diameter of 1 μm or less per $mm^2$ are required to be present in the steel. As for chips during cutting, the use of the sulfide particles with the equivalent circle diameter of less than 1 μm alone results in continuous chips, which deteriorates processability. However, while the fine sulfide particles with the equivalent circle diameter of less than 1 μm are dispersed, relatively large sulfide particles in a certain range, more specifically, 500 or more sulfide particles with an equivalent circle diameter of 1 μm or more and 5 μm or less per $mm^2$ are present, so that chip handling during cutting can also be significantly improved.

The following describes conditions for manufacturing the free-cutting steel.

A rectangular cast steel of the above composition, whose cross section perpendicular to a longitudinal direction has a side length of 200 mm or more, is formed. The cast steel is hot-rolled into a billet at a surface reduction rate of 60% or more, and the billet is hot-worked into a steel bar at a heating temperature of 1050° C. or more and a surface reduction rate of 65% or more.

First, molten steel the composition of which is adjusted as described above is cast to make the cast steel. It is preferable to use the rectangular cast steel the cross section of which perpendicular to the longitudinal direction has a side length of 200 mm or more.

The cast steel is manufactured, as a cast steel with rectangular cross section, by continuous casting or ingot making. When the side length of the rectangular cross section is smaller than 200 mm, the sizes of sulfide particles and Pb particles increase during solidification of the cast steel. Therefore, coarse sulfide particles and Pb particles remain even after the rolling is sequentially performed into the billet, which is disadvantageous to refinement after rolling of a rod bar. Therefore, the side length of the cross section of the cast steel should be 200 mm or more. The side length should be preferably 250 mm or more.

Surface reduction rate during hot-rolling of cast steel into billet: 60% or more Since the sizes of the sulfide particles and Pb particles crystallized during casting solidification are relatively large, it is necessary to reduce the sizes to some extent during the hot-rolling. When the surface reduction rate during the hot-rolling (hereinafter also referred to as rolling) is small, the billet is formed with the large sulfide particles and Pb particles. Therefore, it becomes difficult to refine the sulfide particles and Pb particles during heating and working such as rolling when the billet is subsequently hot-rolled into the steel bar. Therefore, the surface reduction rate during the rolling should be 60% or more. The surface reduction rate is preferably 70% or more. An upper limit need not be regulated, but from the viewpoint of surface properties of a final product, the surface reduction rate is preferably 90% or less.

The cast steel is rolled into the billet by the above-described rolling. The size of the billet need not be limited, as long as the surface reduction rate in the final product can be secured. However, it is preferable to form the billet the cross section of which perpendicular to the longitudinal direction has a size of (120 mm×120 mm) or more.

In other words, a billet whose the cross-sectional area is less than (120 mm×120 mm) is disadvantageous for Pb refinement, because a cross-sectional reduction rate becomes small when the billet is subsequently hot-worked into a steel bar. Therefore, the cross-sectional area of the billet is preferably (120 mm×120 mm) or more. The cross-sectional area of the billet is more preferably (150 mm×150 mm) or more.

Billet heating temperature: 1050° C. or more

Heating temperature when the billet is made into the steel bar is an important factor. When the heating temperature is less than 1050° C., the sulfide particles and the Pb particles are not finely dispersed, which causes less lubrication action during cutting work. As a result, tool life is shortened due to increased tool wear. Therefore, the billet heating temperature should be 1050° C. or more. The billet heating temperature is more preferably 1080° C. or more. Although there is no need to regulate an upper limit, the billet heating temperature is preferably 1250° C. or less from the viewpoint of restraining yield loss due to scale loss.

Surface reduction rate during hot-working of billet into steel bar: 65% or more

The surface reduction rate during the hot-working of the billet into the steel bar is also an important factor for refinement of the sulfide particles and the Pb particles. When the surface reduction rate is less than 65%, the refinement of the sulfide particles and the Pb particles is not sufficient, so a lower limit of the surface reduction rate should be 65%. The surface reduction rate is more preferably 70% or more.

EXAMPLES

Next, our free-cutting steel will be described in detail according to examples.

Steel of chemical compositions illustrated in Table 1 was cast in a continuous casting machine into rectangular cast steels whose cross sections perpendicular to a longitudinal direction have dimensions illustrated in Table 2. The obtained cast steels were rolled into steel bars under manufacturing conditions illustrated in Table 2. Namely, the cast steels were hot-rolled at a heating temperature and a surface reduction rate illustrated in Table 2 into rectangular billets with a long side dimension and a short side dimension illustrated in Table 2. The obtained billets were heated at a heating temperature illustrated in Table 2 and hot-rolled into steel bars with a diameter illustrated in Table 2. The obtained steel bars (steel of examples and comparative examples) were subjected to the following tests.

TABLE 1

(% by mass)

| No. | C | Si | Mn | P | S | Cr | Al | N | Pb | O | Otters | A value * | Category |
|---|---|---|---|---|---|---|---|---|---|---|---|---|---|
| 1 | 0.05 | 0.01 | 1.18 | 0.081 | 0.333 | 0.08 | 0.002 | 0.0079 | 0.08 | 0.0129 | — | 4.7 | Example |
| 2 | 0.09 | 0.08 | 0.81 | 0.036 | 0.595 | 1.77 | 0.003 | 0.0055 | 0.09 | 0.0210 | — | 16.2 | Example |
| 3 | 0.14 | 0.07 | 0.93 | 0.054 | 0.435 | 1.52 | 0.001 | 0.0095 | 0.05 | 0.0222 | — | 19.6 | Example |
| 4 | 0.03 | 0.02 | 0.50 | 0.063 | 0.231 | 0.55 | 0.002 | 0.0102 | 0.03 | 0.0169 | — | 14.1 | Example |
| 5 | 0.07 | 0.01 | 0.99 | 0.049 | 0.523 | 0.95 | 0.001 | 0.0088 | 0.02 | 0.0204 | — | 11.0 | Example |

TABLE 1-continued

| | (% by mass) | | | | | | | | | | | | |
|---|---|---|---|---|---|---|---|---|---|---|---|---|---|
| No. | C | Si | Mn | P | S | Cr | Al | N | Pb | O | Otters | A value * | Category |
| 6 | 0.08 | 0.02 | 1.85 | 0.008 | 0.401 | 1.03 | 0.002 | 0.0077 | 0.07 | 0.0133 | Ca: 0.0002 | 17.5 | Example |
| 7 | 0.04 | — | 1.12 | 0.007 | 0.640 | 0.87 | 0.001 | 0.0054 | 0.04 | 0.0145 | Se: 0.15 | 8.5 | Example |
| 8 | 0.08 | 0.01 | 1.77 | 0.082 | 0.312 | 0.81 | 0.001 | 0.0103 | 0.09 | 0.0132 | Te: 0.12 | 18.7 | Example |
| 9 | 0.06 | 0.06 | 1.45 | 0.091 | 0.554 | 1.16 | 0.002 | 0.0099 | 0.08 | 0.0254 | Bi: 0.08 | 13.1 | Example |
| 10 | 0.10 | 0.05 | 0.82 | 0.080 | 0.556 | 1.12 | 0.003 | 0.0065 | 0.05 | 0.0165 | Sn: 0.008, Sb: 0.053 | 11.5 | Example |
| 11 | 0.09 | 0.03 | 0.95 | 0.036 | 0.357 | 1.05 | 0.001 | 0.0045 | 0.07 | 0.0231 | B: 0.004 | 17.4 | Example |
| 12 | 0.10 | 0.01 | 0.75 | 0.011 | 0.420 | 0.84 | 0.002 | 0.0078 | 0.09 | 0.0199 | Cu: 0.23, Ni: 0.35 | 11.8 | Example |
| 13 | 0.08 | 0.05 | 1.86 | 0.023 | 0.345 | 1.01 | 0.001 | 0.0123 | 0.09 | 0.0222 | Ti: 0.082 | 20.0 | Example |
| 14 | 0.07 | — | 0.76 | 0.068 | 0.364 | 0.55 | 0.002 | 0.0089 | 0.07 | 0.0163 | V: 0.010, Zr: 0.05 | 9.6 | Example |
| 15 | 0.06 | 0.01 | 1.23 | 0.084 | 0.395 | 1.22 | 0.001 | 0.0123 | 0.08 | 0.0234 | Mg: 0.0010 | 18.6 | Example |
| 16 | 0.16 | 0.03 | 0.75 | 0.008 | 0.382 | 0.23 | 0.001 | 0.0078 | 0.06 | 0.0198 | — | 5.0 | Comparative example |
| 17 | 0.09 | 0.15 | 1.78 | 0.013 | 0.435 | 0.78 | 0.005 | 0.0076 | 0.07 | 0.0231 | — | 13.1 | Comparative example |
| 18 | 0.15 | 0.01 | 0.44 | 0.071 | 0.348 | 0.48 | 0.005 | 0.0075 | 0.08 | 0.0256 | — | 8.2 | Comparative example |
| 19 | 0.12 | — | 2.13 | 0.008 | 0.412 | 0.98 | 0.001 | 0.0025 | 0.06 | 0.0156 | — | 17.1 | Comparative example |
| 20 | 0.09 | — | 0.84 | 0.120 | 0.406 | 0.25 | 0.003 | 0.0063 | 0.06 | 0.0146 | — | 5.1 | Comparative example |
| 21 | 0.07 | — | 0.65 | 0.009 | 0.196 | 0.65 | 0.001 | 0.0105 | 0.04 | 0.0131 | — | 19.9 | Comparative example |
| 22 | 0.07 | 0.01 | 0.55 | 0.008 | 0.685 | 1.13 | 0.005 | 0.0090 | 0.06 | 0.0126 | — | 9.1 | Comparative example |
| 23 | 0.14 | 0.01 | 1.46 | 0.002 | 0.352 | 0.04 | 0.003 | 0.0023 | 0.09 | 0.0162 | — | 4.7 | Comparative example |
| 24 | 0.08 | 0.01 | 0.65 | 0.005 | 0.567 | 2.09 | 0.004 | 0.0069 | 0.08 | 0.0175 | — | 19.6 | Comparative example |
| 25 | 0.12 | 0.03 | 0.98 | 0.004 | 0.423 | 1.34 | 0.001 | 0.0065 | 0.01 | 0.0269 | — | 18.2 | Comparative example |
| 26 | 0.05 | 0.01 | 1.05 | 0.001 | 0.349 | 1.06 | 0.015 | 0.0069 | 0.03 | 0.0213 | — | 18.2 | Comparative example |
| 27 | 0.13 | 0.01 | 0.86 | 0.006 | 0.399 | 0.99 | 0.005 | 0.004 | 0.06 | 0.0145 | — | 14.6 | Comparative example |
| 28 | 0.07 | 0.02 | 1.15 | 0.005 | 0.391 | 1.31 | 0.002 | 0.018 | 0.08 | 0.0171 | — | 19.7 | Comparative example |
| 29 | 0.07 | — | 0.64 | 0.015 | 0.406 | 0.95 | 0.003 | 0.0145 | 0.05 | 0.0089 | — | 13.3 | Comparative example |
| 30 | 0.09 | — | 1.25 | 0.010 | 0.388 | 1.05 | 0.006 | 0.0065 | 0.03 | 0.0513 | — | 16.8 | Comparative example |
| 31 | 0.07 | 0.01 | 0.55 | 0.013 | 0.523 | 0.30 | 0.001 | 0.0098 | 0.04 | 0.0147 | — | 3.9 | Comparative example |
| 32 | 0.08 | 0.08 | 1.68 | 0.016 | 0.349 | 1.23 | 0.002 | 0.0111 | 0.06 | 0.0123 | — | 22.4 | Comparative example |

* A value = (Mn + 5 Cr)/S: applicable range of 4.0 to 20.0

"—" in table indicates less than 0.01.

Specimens were taken from the cross sections of the obtained steel bars parallel to a rolling direction, and observation was made with a scanning electron microscope (SEM) at a position of ¼ axial center of a diameter from a periphery of the cross section in a radial direction to determine equivalent circle diameters and number densities of sulfide particles and Pb particles in the steel. The compositions of sulfide particles and Pb particles were analyzed by energy dispersive X-ray spectrometry (EDX). After the sulfide particles and Pb particles were identified by EDX, binarization was performed by image analysis on obtained SEM images, to obtain the equivalent circle diameters and number densities.

Machinability was evaluated by an external turning test (cutting test). Namely, BNC-34C5 manufactured by Citizen Machinery Co., Ltd. was used as a cutting machine, and carbide EX35 bites TNGG160404R-N manufactured by Hitachi Tool Engineering, Ltd. and DTGNR2020 manufactured by Kyocera Corporation were used as a turning tip and a holder, respectively. A 15-fold diluted emulsion solution of Yushiroken FGE283PR manufactured by Yushiro Chemical Industry Co., Ltd. was used as a lubricant. Cutting conditions were as follows: a cutting speed of 100 m/min, a feed speed of 0.05 mm/rev, a cut depth of 2.0 mm, and a work length of 10 m.

The machinability was evaluated by tool's flank wear Vb after the above cutting test over a length of 10 m. As illustrated in Table 2, the machinability was evaluated to be "good" when the flank wear Vb after the cutting test was 200 μm or less, and "poor" when the flank wear exceeds 200 μm.

TABLE 2

| | | Hot rolling | | | | Hot working | | | |
|---|---|---|---|---|---|---|---|---|---|
| No. | Steel No. | Long side of cross-sectional dimensions of cast steel (mm) | Short side of cross-sectional dimensions of cast steel (mm) | Cross-sectional area ($mm^2$) | Surface reduction rate (%) | Long side of cross-sectional dimensions of billet (mm) | Short side of cross-sectional dimensions of billet (mm) | Cross-sectional area ($mm^2$) | Heating temperature (° C.) |
| 1 | 1 | 400 | 300 | 120000 | 79 | 160 | 160 | 25600 | 1120 |
| 2 | 2 | 400 | 300 | 120000 | 79 | 160 | 160 | 25600 | 1100 |
| 3 | 3 | 400 | 300 | 120000 | 79 | 160 | 160 | 25600 | 1100 |
| 4 | 4 | 400 | 300 | 120000 | 79 | 160 | 160 | 25600 | 1100 |
| 5 | 5 | 400 | 300 | 120000 | 79 | 160 | 160 | 25600 | 1100 |
| 6 | 6 | 400 | 300 | 120000 | 79 | 160 | 160 | 25600 | 1100 |
| 7 | 7 | 400 | 300 | 120000 | 79 | 160 | 160 | 25600 | 1100 |
| 8 | 8 | 400 | 300 | 120000 | 79 | 160 | 160 | 25600 | 1100 |
| 9 | 9 | 400 | 300 | 120000 | 79 | 160 | 160 | 25600 | 1100 |
| 10 | 10 | 400 | 300 | 120000 | 79 | 160 | 160 | 25600 | 1100 |
| 11 | 11 | 400 | 300 | 120000 | 86 | 130 | 130 | 16900 | 1100 |
| 12 | 12 | 400 | 300 | 120000 | 81 | 150 | 150 | 22500 | 1100 |
| 13 | 13 | 400 | 300 | 120000 | 79 | 160 | 160 | 25600 | 1100 |

TABLE 2-continued

| | | | | | | | | | |
|---|---|---|---|---|---|---|---|---|---|
| 14 | 14 | 400 | 300 | 120000 | 86 | 130 | 130 | 16900 | 1100 |
| 15 | 15 | 400 | 300 | 120000 | 79 | 160 | 160 | 25600 | 1100 |
| 16 | 3 | 200 | 200 | 40000 | 61 | 125 | 125 | 15625 | 1050 |
| 17 | 5 | 200 | 200 | 40000 | 61 | 125 | 125 | 15625 | 1050 |
| 18 | 1 | 350 | 190 | 66500 | 62 | 160 | 160 | 25600 | 1100 |
| 19 | 1 | 250 | 240 | 60000 | 57 | 160 | 160 | 25600 | 1100 |
| 20 | 1 | 400 | 300 | 120000 | 67 | 200 | 200 | 40000 | 1100 |
| 21 | 1 | 400 | 300 | 120000 | 79 | 160 | 160 | 25600 | 1000 |
| 22 | 1 | 400 | 300 | 120000 | 84 | 140 | 140 | 19600 | 1100 |
| 23 | 16 | 400 | 300 | 120000 | 79 | 160 | 160 | 25600 | 1100 |
| 24 | 17 | 400 | 300 | 120000 | 79 | 160 | 160 | 25600 | 1100 |
| 25 | 18 | 400 | 300 | 120000 | 79 | 160 | 160 | 25600 | 1100 |
| 26 | 19 | 400 | 300 | 120000 | 79 | 160 | 160 | 25600 | 1100 |
| 27 | 20 | 400 | 300 | 120000 | 79 | 160 | 160 | 25600 | 1100 |
| 28 | 21 | 400 | 300 | 120000 | 79 | 160 | 160 | 25600 | 1100 |
| 29 | 22 | 400 | 300 | 120000 | 79 | 160 | 160 | 25600 | 1100 |
| 30 | 23 | 400 | 300 | 120000 | 79 | 160 | 160 | 25600 | 1100 |
| 31 | 24 | 400 | 300 | 120000 | 79 | 160 | 160 | 25600 | 1100 |
| 32 | 25 | 400 | 300 | 120000 | 79 | 160 | 160 | 25600 | 1100 |
| 33 | 26 | 400 | 300 | 120000 | 79 | 160 | 160 | 25600 | 1100 |
| 34 | 27 | 400 | 300 | 120000 | 79 | 160 | 160 | 25600 | 1100 |
| 35 | 28 | 400 | 300 | 120000 | 79 | 160 | 160 | 25600 | 1100 |
| 36 | 29 | 400 | 300 | 120000 | 79 | 160 | 160 | 25600 | 1100 |
| 37 | 30 | 400 | 300 | 120000 | 79 | 160 | 160 | 25600 | 1100 |
| 38 | 31 | 400 | 300 | 120000 | 79 | 160 | 160 | 25600 | 1100 |
| 39 | 32 | 400 | 300 | 120000 | 79 | 160 | 160 | 25600 | 1100 |

| | | Hot working | | Properties of steelbar (distribution of inclusions, test result of machinability) | | | | |
|---|---|---|---|---|---|---|---|---|
| | | | | Number density of sulfide particles with equivalent circle | Number density of sulfide particles with equivalent circle | Number density of Pb particles with equivalent circle | | |
| No. | Steel No. | Diameter of steelbar (mm) | Surface reduction rate (%) | diameter of less than 1 μm (number/mm$^2$) | diameter of 1 to 5 μm (number/mm$^2$) | diameter of 1 μm or less (number/mm$^2$) | Machinability | Category |
| 1 | 1 | 30 | 97 | 1562 | 869 | 3321 | Good | Example |
| 2 | 2 | 30 | 97 | 7059 | 1869 | 4026 | Good | Example |
| 3 | 3 | 30 | 97 | 4044 | 1650 | 1532 | Good | Example |
| 4 | 4 | 30 | 97 | 1294 | 562 | 1205 | Good | Example |
| 5 | 5 | 30 | 97 | 4621 | 2694 | 1469 | Good | Example |
| 6 | 6 | 30 | 97 | 4488 | 2236 | 3016 | Good | Example |
| 7 | 7 | 30 | 97 | 5402 | 2887 | 4652 | Good | Example |
| 8 | 8 | 30 | 97 | 3702 | 1647 | 4412 | Good | Example |
| 9 | 9 | 30 | 97 | 6214 | 2659 | 2369 | Good | Example |
| 10 | 10 | 30 | 97 | 5955 | 2478 | 1423 | Good | Example |
| 11 | 11 | 30 | 96 | 3811 | 1845 | 4036 | Good | Example |
| 12 | 12 | 60 | 87 | 3572 | 2552 | 4860 | Good | Example |
| 13 | 13 | 70 | 85 | 4685 | 2014 | 4215 | Good | Example |
| 14 | 14 | 65 | 80 | 2370 | 1263 | 4189 | Good | Example |
| 15 | 15 | 30 | 97 | 5074 | 2547 | 3888 | Good | Example |
| 16 | 3 | 83 | 65 | 1184 | 573 | 1627 | Good | Example |
| 17 | 5 | 83 | 65 | 1347 | 637 | 1187 | Good | Example |
| 18 | 1 | 30 | 97 | 569 | 759 | 756 | Poor | Comparative example |
| 19 | 1 | 30 | 97 | 874 | 814 | 834 | Poor | Comparative example |
| 20 | 1 | 135 | 64 | 842 | 746 | 966 | Poor | Comparative example |
| 21 | 1 | 30 | 97 | 768 | 559 | 645 | Poor | Comparative example |
| 22 | 1 | 95 | 64 | 964 | 852 | 926 | Poor | Comparative example |
| 23 | 16 | 30 | 97 | 2567 | 1004 | 1269 | Poor | Comparative example |
| 24 | 17 | 30 | 97 | 865 | 743 | 847 | Poor | Comparative example |
| 25 | 18 | 30 | 97 | 786 | 695 | 1679 | Poor | Comparative example |
| 26 | 19 | 30 | 97 | 946 | 510 | 760 | Poor | Comparative example |
| 27 | 20 | 30 | 97 | 1554 | 334 | 1003 | Poor | Comparative example |

TABLE 2-continued

| | | | | | | | | |
|---|---|---|---|---|---|---|---|---|
| 28 | 21 | 30 | 97 | 1124 | 246 | 1114 | Poor | Comparative example |
| 29 | 22 | 30 | 97 | 456 | 756 | 1879 | Poor | Comparative example |
| 30 | 23 | 30 | 97 | 896 | 501 | 2214 | Poor | Comparative example |
| 31 | 24 | 30 | 97 | 887 | 678 | 1864 | Poor | Comparative example |
| 32 | 25 | 30 | 97 | 3156 | 786 | 142 | Poor | Comparative example |
| 33 | 26 | 30 | 97 | 2019 | 846 | 1006 | Poor | Comparative example |
| 34 | 27 | 30 | 97 | 1823 | 842 | 1326 | Poor | Comparative example |
| 35 | 28 | 30 | 97 | 1753 | 703 | 1897 | Poor | Comparative example |
| 36 | 29 | 30 | 97 | 956 | 659 | 2423 | Poor | Comparative example |
| 37 | 30 | 30 | 97 | 1468 | 1118 | 1265 | Poor | Comparative example |
| 38 | 31 | 30 | 97 | 914 | 664 | 987 | Poor | Comparative example |
| 39 | 32 | 30 | 97 | 714 | 895 | 856 | Poor | Comparative example |

*1 Underlines indicate out of range.
*2 Number density of sulfide particles with equivalent circle diameter of less than 1 μm: 1000 or more number/$mm^2$
*3 Number density of sulfide particles with equivalent circle diameter of 1 to 5 μm: 500 or more number/$mm^2$
*4 Number density of Pb particles with equivalent circle diameter of 1 μm or less: 1000 or mor number/$mm^2$ Table 2 illustrates the test results for the steel of examples and comparative examples. As is apparent from Table 2, the steel of the examples has good machinability compared to the steel of the comparative examples.

The invention claimed is:

1. A free-cutting steel comprising:

a composition of, in % by mass, 0.15% or less of C, 0.5% or more and 2.0% or less of Mn, 0.200% or more and 0.650% or less of S, more than 0.01% and 0.05% or less of O, 0.05% or more and 2.00% or less of Cr, 0.02% or more and less than 0.10% of Pb, 0.005% or more and 0.015% or less of N, with an A value defined by a following formula (1) satisfying 4.0 or more and 20.0 or less, and a remainder being Fe and unavoidable impurities; and a microstructure with 1000 or more sulfide particles with an equivalent circle diameter of less than 1 μm per $mm^2$, 500 or more sulfide particles with an equivalent circle diameter of 1 μm or more and 5 μm or less per $mm^2$, and 1000 or more Pb particles with an equivalent circle diameter of 1 μm or less per $mm^2$, wherein $$A\ value=(Mn+5Cr)/S \quad (1)$$

here, symbols of elements in the formula (1) indicate contents, in % by mass, of the elements.

2. The free-cutting steel according to claim 1, wherein the composition further contains, in % by mass, any one or more of:

0.10% or less of Si;

0.01% or more and 0.15% or less of P; and 0.010% or less of Al.

3. The free-cutting steel according to claim 1, wherein the composition further contains, in % by mass, any one or more of:

0.0010% or less of Ca;

0.30% or less of Se;

0.15% or less of Te;

0.20% or less of Bi;

0.020% or less of Sn;

0.025% or less of Sb;

0.010% or less of B;

0.50% or less of Cu;

0.50% or less of Ni;

0.100% or less of Ti;

0.20% or less of V;

0.050% or less of Zr; and 0.0050% or less of Mg.

4. The free-cutting steel according to claim 2, wherein the composition further contains, in % by mass, any one or more of:

0.0010% or less of Ca;

0.30% or less of Se;

0.15% or less of Te;

0.20% or less of Bi;

0.020% or less of Sn;

0.025% or less of Sb;

0.010% or less of B;

0.50% or less of Cu;

0.50% or less of Ni;

0.100% or less of Ti;

0.20% or less of V;

0.050% or less of Zr; and 0.0050% or less of Mg.

* * * * *